US007302724B2

(12) United States Patent
Solomon et al.

(10) Patent No.: US 7,302,724 B2
(45) Date of Patent: Dec. 4, 2007

(54) PLAY MAT AND METHOD OF ASSEMBLY

(76) Inventors: Angela Danielle Solomon, 258 Big Ridge Dr., East Stroudsburg, PA (US) 18301; Luis H. Solomon, 258 Big Ridge Dr., East Stroudsburg, PA (US) 18301

( * ) Notice: Subject to any disclaimer, the term of this patent is extended or adjusted under 35 U.S.C. 154(b) by 132 days.

(21) Appl. No.: 11/130,425

(22) Filed: May 16, 2005

(65) Prior Publication Data

US 2006/0253987 A1 Nov. 16, 2006

(51) Int. Cl.
*A47D 13/00* (2006.01)

(52) U.S. Cl. ..... 5/655; 5/97; 5/417

(58) Field of Classification Search ..... 5/414, 5/416–420, 655, 97; 135/124, 137, 128, 135/135; 446/71, 73, 227; D6/596
See application file for complete search history.

(56) References Cited

U.S. PATENT DOCUMENTS

| | | | | |
|---|---|---|---|---|
| 2,078,022 | A * | 4/1937 | Roemer | 446/227 |
| 3,105,505 | A * | 10/1963 | Maybee | 135/135 |
| 5,035,013 | A | 7/1991 | Bloom | |
| 5,059,463 | A * | 10/1991 | Peters | 428/64.1 |
| D359,869 | S | 7/1995 | Oren | |
| D408,129 | S * | 4/1999 | Spraulding | D3/205 |
| D408,192 | S | 4/1999 | Chiang | |
| 5,930,854 | A * | 8/1999 | O'Neill et al. | 5/655 |
| 6,167,898 | B1 * | 1/2001 | Larga et al. | 135/137 |
| 6,199,229 | B1 * | 3/2001 | Wong | 5/417 |
| 6,408,463 | B1 | 6/2002 | Palacio | |
| 6,702,643 | B1 * | 3/2004 | Drosendahl et al. | 446/227 |
| 6,785,921 | B1 | 9/2004 | Conforti | |
| 7,117,552 | B2 * | 10/2006 | Hoffman | 5/655 |
| 2002/0020439 | A1 * | 2/2002 | Tate | 135/124 |
| 2004/0266312 | A1 * | 12/2004 | Oren et al. | 446/227 |

OTHER PUBLICATIONS

Baby Epstein Mat—Internet, Amazon.com Jun. 5, 2004.
Tiny Love Super Deluxe Gymini Light and Music—Internet, Amazon.com Mar. 14, 2005.
Tiny Love Gymini 3D Activity Gym—Internet, Amazon.com Mar. 14, 2005.

* cited by examiner

*Primary Examiner*—Michael Trettel
(74) *Attorney, Agent, or Firm*—Knight Law Services; Lisa M. Knight, Esq.

(57) ABSTRACT

The present invention is an infant play mat. This play mat is designed so that it is light-weight and easily portable. The play mat includes a cushioned base and at least two arching supports that are capable of folding. Each support arch is detachably coupled to two height extension members that are detachably coupled to the base. The height extension members allow the height of the supports to be increased or decreased relative to the base so that the mat can be used by infants of various sizes and ages. In one embodiment each support includes at least two flexible joints which enable the support to be folded compactly so as to provide enhanced portability. The mat can be easily folded by detaching the supports and/or height extension members from the base so that both the supports and the base can be folded then placed into a carrying case.

48 Claims, 14 Drawing Sheets

PLAY MAT AND METHOD OF ASSEMBLY

The present invention relates to an improved play mat and a method of assembly for the improved play mat.

BACKGROUND

In the past the majority of infant play mats have been designed to accommodate small or newborn infants. Such designs did not include any mechanism that would allow the height of a mat's support arches to be adjusted or increased as the infant grows in size. A height adjustment feature is desirable particularly for mat designs that include toys or objects that are attached to the support arches. These toys and objects hang above the infant as it rests or plays on the base portion of the mat. If the height of the support arches is not sufficiently high relative to the base portion of the mat some infants may able to pull the hanging toys down onto themselves. Therefore, the lack of height adjustability is a disadvantage in some mats with hanging toys and objects.

Another disadvantage of the previously designed mats is that they are typically quite bulky which makes portability difficult. The bulky design of such mats is a problem that is encountered by many parents that are very mobile and would like to be able to travel with the play mat. Often parents are forced to leave the play mat behind because the design makes it impracticable or difficult to transport from place to place.

Another disadvantage of some of the mats designed previously is that the method of assembly and disassembly is often complicated and time consuming. The additional time required to assemble and disassemble such mats usually detracts from the time and attention that would otherwise be spent on the infant.

Another disadvantage of some mats is that they are difficult to clean. Mats that are difficult to clean often will be discarded prematurely and therefore do not last as long as they could if they were easier to clean.

For the foregoing reasons, there is a need for a mat that includes a mechanism that can be adjusted to accommodate the height and size of any infant that uses it. Also for the foregoing reasons, there is a need for a light weight play mat that can be folded in a compact manner so that it is easy to transport from place to place.

For the foregoing reasons, there is a need for a play mat that is easy to assemble and disassemble. Also for the foregoing reasons, there is a need for a play mat that is durable and easy to wash.

SUMMARY

Accordingly, the object of the present invention is to eliminate some of the disadvantages found in the previous mat designs. More specifically, an object of the present invention is to provide a play mat that can be adjusted to accommodate the height and size of almost any infant that uses it.

Another object of the present invention is to provide a light weight play mat that can be folded in a compact manner so that it is easy to transport from place to place. Yet another object of the present invention is to provide a play mat that is relatively easy to assemble and disassemble. Yet another object of the present invention is to provide a play mat that is durable and easy to wash.

In general, in a first aspect, the invention comprises a base, a plurality of telescoping mechanisms where each telescoping mechanism has a receiving portion and a plurality of hinges. It also comprises a plurality of supports each having a top end and a bottom end, wherein the bottom end of each support is detachably coupled to the receiving portion of each telescoping mechanism and the bottom end of each telescoping mechanism is detachably coupled to the base. At least two hinges are coupled to each support to allow each support to be folded. The top end of each support is coupled to the top end of another support so that the supports intersect over the base.

In a second aspect, the invention comprises a base, and a plurality of supports that each has a top end and a bottom end. The bottom end of each support is detachably coupled to the base. Each support includes a plurality of flexible joints that enable each support to be folded. The top end of each support is coupled to the top end of another support so that the supports intersect over the base.

In a third aspect, the invention comprises a base and a plurality of height extension members. It also comprises a plurality of supports each having a top end and a bottom end, wherein the bottom end of each support is detachably coupled to each height extension member and the bottom end of each height extension member is detachably coupled to the base. The top end of each support is coupled to the top end of another support so that the supports intersect over the base.

In a fourth aspect, the invention comprises a base, and a plurality of telescoping supports having a top end and a bottom end. The bottom end of each the support is detachably coupled to the base and wherein the top end of each telescoping support is coupled to the top end of another support so that the plurality of telescoping supports intersect over the base.

In a fifth aspect, the invention features a base and a plurality of supports each having a top end and a bottom end. The invention also includes a plurality of height extension means for extending the height of each support relative to the base, wherein the top end of each height extension means is detachably coupled to the bottom end of each support and the bottom end of each height extension means is detachably coupled to the base. Moreover, the top end of each support is coupled to the top end of another support so that the supports intersect over the base.

In a sixth aspect, the invention features a method of assembly for a mat that includes the steps of placing a base on a rigid surface, unfolding a plurality of supports wherein each support has a top end and a bottom end, detachably coupling the bottom end of a height extension member to the base. It also includes detachably coupling the top end of the height extension member to the bottom end of each support and coupling the top end of each support to the top end of another support so that the supports intersect over the base.

Embodiments of the invention may include one or more of the following features. An optional feature of the play mat presented is that the top end of each support is detachably coupled to the top end of another support so that the supports can be detached from each other for mat disassembly. The top end of each support may be coupled the top end of another support using a push button coupling mechanism.

Another optional feature of the play mat presented is that the base further includes a receiving portion that receives the bottom end of each height extension member so that the support is detachably coupled to the base. The receiving portion in the base may also be used to receive the bottom end of each support.

Yet another optional feature of the play mat presented is that the support further includes a plurality of flexible joints that enable each support to be folded.

Yet another optional feature of the play mat presented is that each support further includes a plurality of locking mechanisms that when engaged allow each support to remain locked in an unfolded position until each locking mechanism is disengaged.

Yet another optional feature of the play mat presented is that the base includes cushioned fabric.

Yet another optional feature of the play mat presented is that the base includes an accessible interior area to hold an audio recording/playback device.

Yet another optional feature of the play mat presented is that it further includes an audio play/recording device.

Yet another optional feature of the play mat presented is that it further includes an attachment means for coupling objects to each support.

Yet another optional feature of the play mat presented is that it further includes a carrying case, wherein the mat when dissembled can fit into the carrying case for ease of transporting the mat.

Yet another optional feature of the play mat presented is that the base is foldable so that it fits into a carrying case along with a plurality of supports.

Yet another optional feature of the play mat presented is that the carrying case is a backpack.

The play mat presented may also feature the optional steps of: removing the base, the plurality of supports, and the plurality of height extension members from a carrying case. Additionally, the play mat presented may also include the steps of engaging a locking mechanism that allows the supports to remain in the unfolded extended position until disengaged, adjusting the plurality of height extension members to change the height of the plurality of supports relative to the base, attaching an attachment means having objects to the plurality of supports, and activating an audio playing/recording device so that the infant can listen to a recorded audio program.

The above advantages, aspects and features are of representative embodiments only. It should be understood that they are not to be considered limitations on the mat or method of assembly therefore as defined by the claims.

BRIEF DESCRIPTION OF THE DRAWINGS

The features and advantages of the mat and method of assembly therefore will become apparent from the following detailed description, claims and accompanying drawings in which like references denote like or corresponding parts, in which:

DETAILED DESCRIPTION

As is shown in the figures and description, this play mat has several embodiments that make it very useful. The variations of Mat 100 include a variety of different base shapes, flexible joint types, modes of connecting the components of the mat together, supports and height extension member designs that are interchangeable. Although certain embodiments of this invention have been described, the spirit and scope of the invention is not limited to the description provided herein.

Figure 1A:
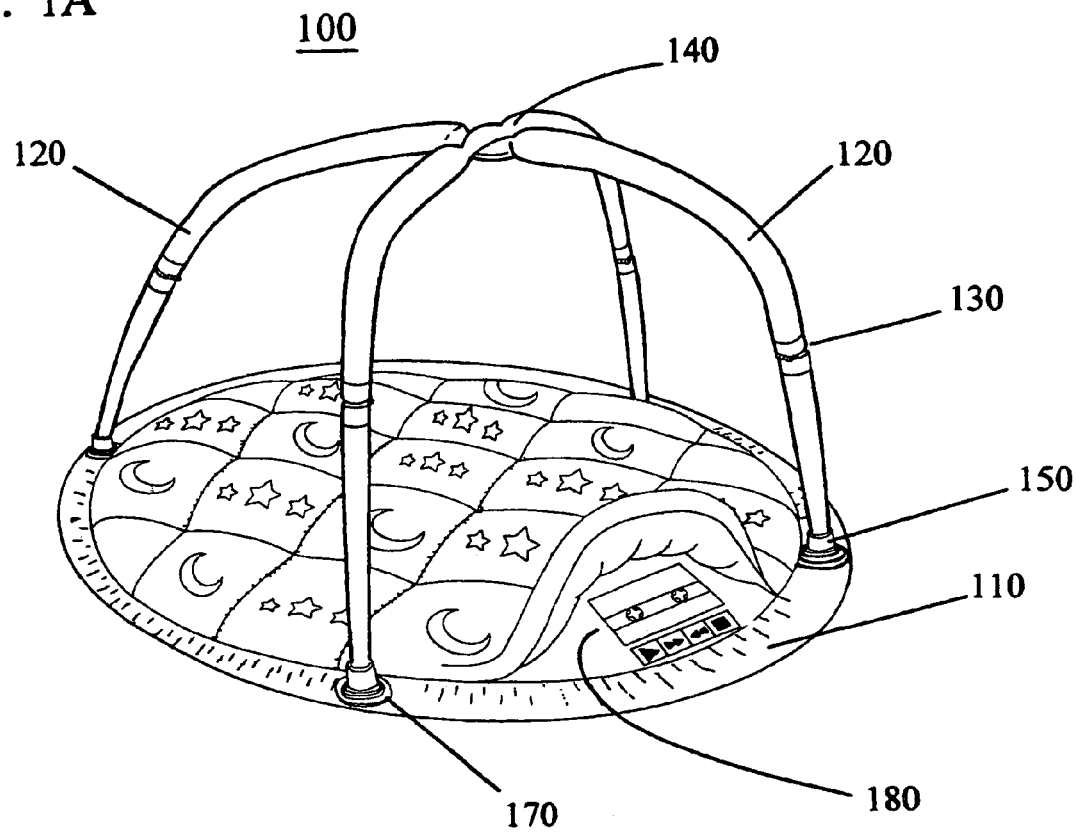
FIG. 1A shows a side view of one embodiment of the play mat that includes height extension members and supports having flexible joints, where the play mat is in the fully assembled position.

Referring to FIG. 1A, one embodiment of improved play mat 100 is shown having a base 110, two supports 120, flexible joints 130, top portion of support 140, a plurality of height extension members 150, receiving portion 170 and accessible interior area 180. Base 110 may be shaped substantially like a circle, oval, rectangle or a square. Base 110 may be covered with fabric. Such fabric may be made of a washable and/or stain-resistant decorative material. Optionally, base 110 may be made of material that is cushioned, padded or filled with foam. Base 110 may also be constructed so that it is sufficiently thick so as to provide a soft, comfortable resting surface for the infant that is placed on it. Optionally, the thickness of base 110 ranges from 0.25 to 2.0 inches thick. Base 110, when shaped like a circle may have a diameter of 42 inches. Similarly, base 110, when shaped like an oval may also have at least one diameter that is 42 inches. Alternatively, base 110, when shaped like a square may be 42 by 42 inches and when shaped like a rectangle may have the dimensions of 42 by 50 inches. Alternatively, base 110 may be constructed using dimensions that fall within 10 inches larger or smaller than the specific dimensions mentioned above.

In one embodiment of play mat 100, base 110 includes receiving portion 170 that receives bottom end of height extension member 150. Alternatively, in another embodiment of play mat 100, receiving portion 170 is designed to receive the bottom end of support 120. Accessible interior area 180 is an optional area in base 110 that may be included in play mat 100 that holds an audio play/recording device. Optionally, play mat 100 may include an audio play/recording device such as a tape player/recorder, CD player, MP3 player, digital recorder/player, music box, integrated circuit recording/playback device or the like.

Figure 1B:
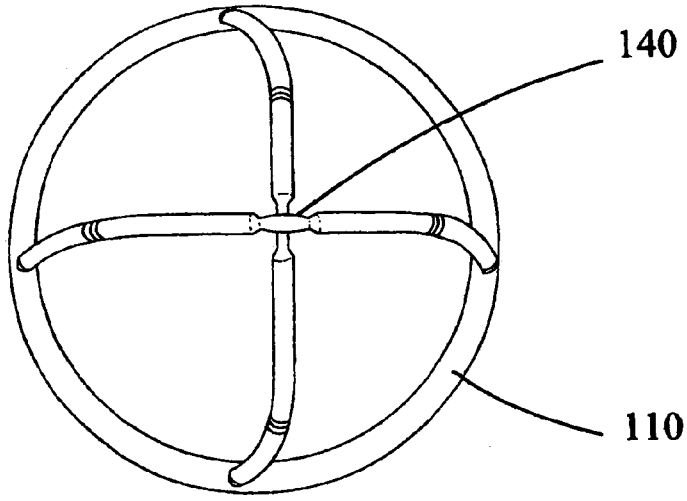
FIG. 1B shows a top view of the play mat shown in FIG. 1A.

Referring to FIG. 1B, the top view of play mat 100 of FIG. 1A is shown.

Figure 1C:
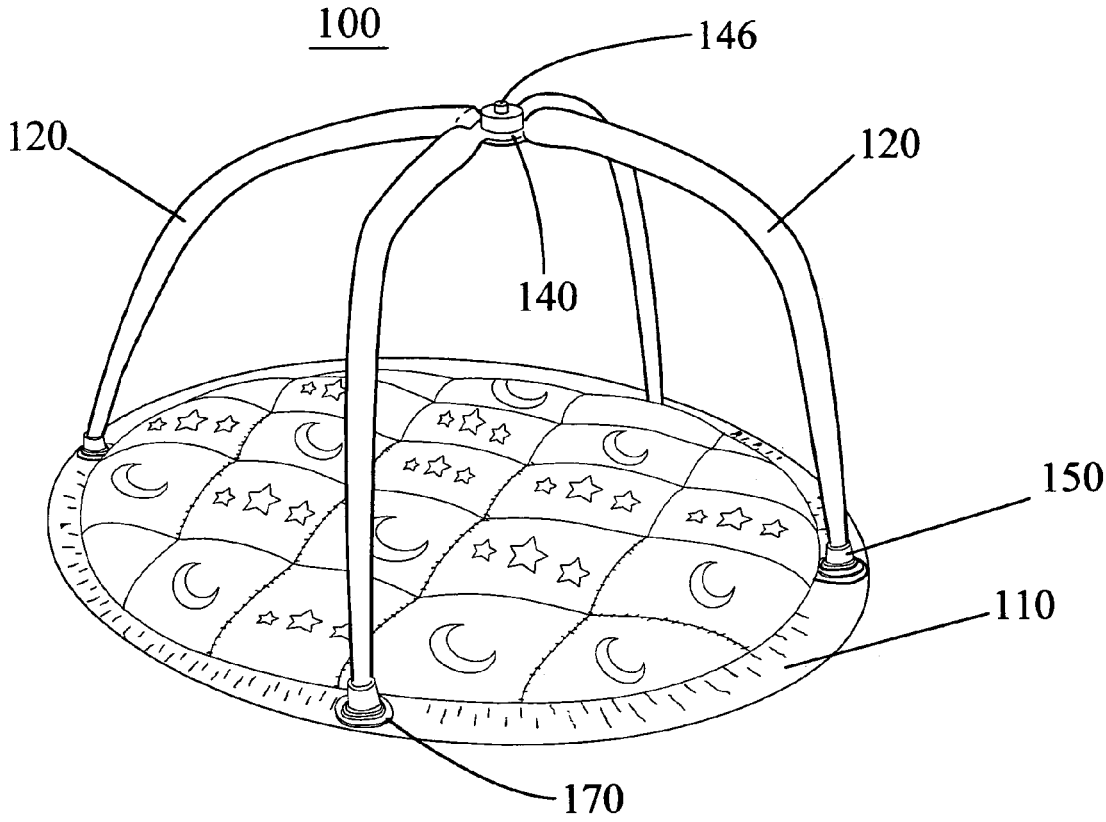
FIG. 1C shows a side view of one embodiment of the play mat without flexible joints in the fully assembled position.

Referring to FIG. 1C, a side view of one embodiment of play mat 100 without flexible joint 130 in the fully assembled position. Also shown in FIG. 1C is a push button coupling mechanism 146 that connects top portion 140 of each support 120 together. Flexible joint 130 and push button coupling mechanism 146 is described in detail below.

Figure 1D:
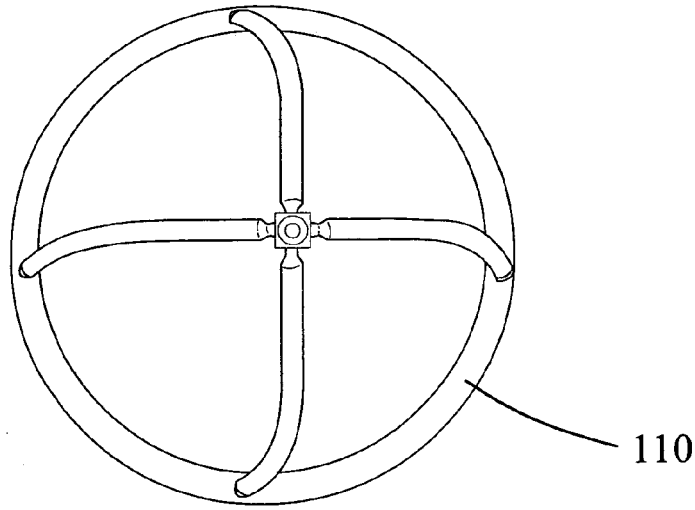
FIG. 1D shows a top view of the play mat shown in FIG. 1C.

Referring to FIG. 1D, a top view of play mat 100 of FIG. 1C is shown.

Figure 2A:
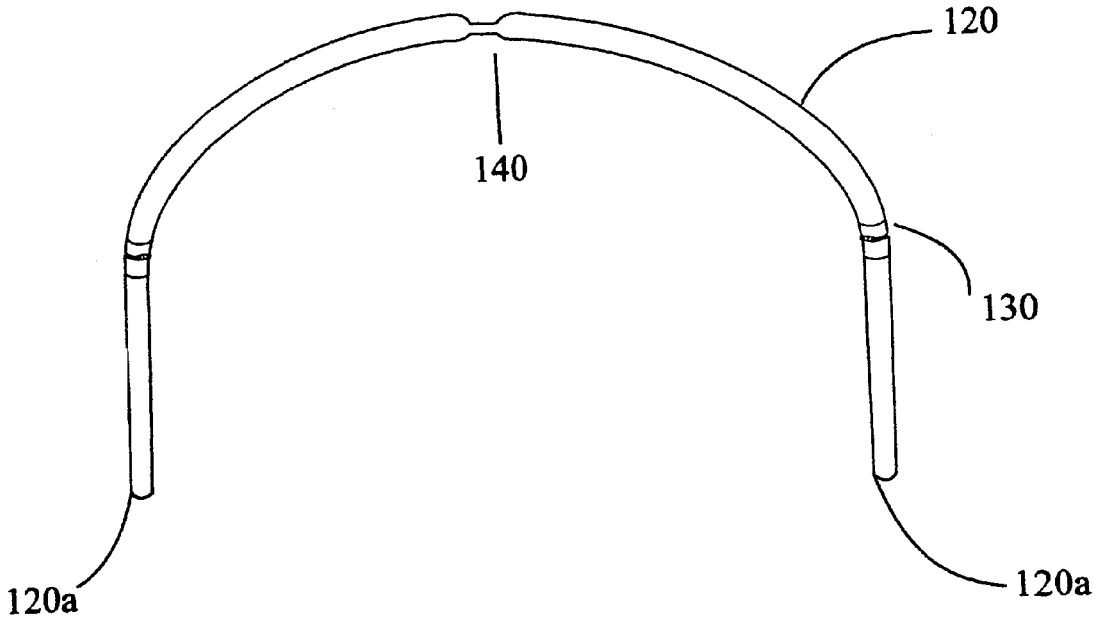
FIG. 2A shows one embodiment of a mat support having flexible joints in the unfolded assembled position.

Referring to FIG. 2A, one embodiment of support 120 is shown having a top end 140 and a bottom end. The bottom end of each support 120 has two parts, 120*a* and 120*b*. In this embodiment, flexible joint 130 is not included. Support 120 may be made of a hollow circularly-shaped material. Alternatively, support 120 may be rectangularly-shaped. Moreover, support 120 may be made of plastic, metal, wood or any suitable synthetic material. Support 120 is preferably made of materials that allow it to be light weight and durable.

Figure 2B:
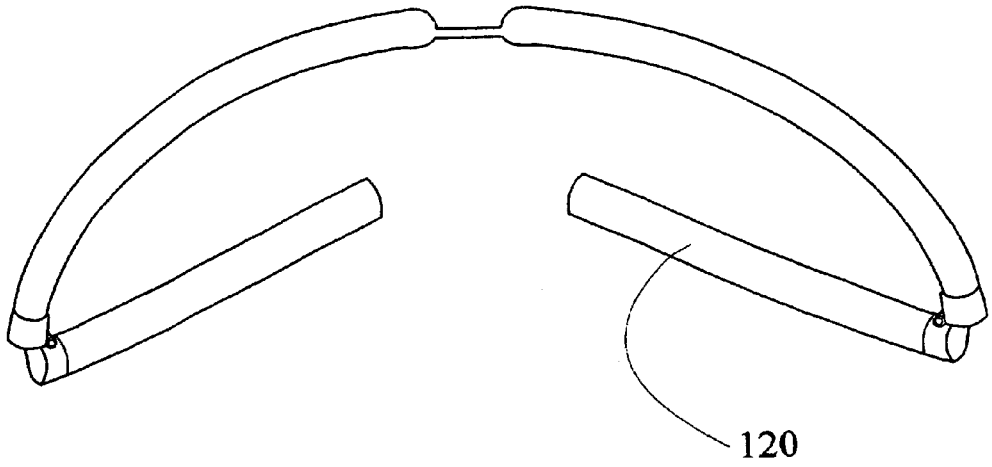
FIG. 2B shows the support shown in FIG. 2A in the folded position.

Support 120 optionally includes a plurality of flexible joints, flexible joint 130. Flexible joint 130 allows support 120 to be folded so that support 120 is reduced in size. The reduction in size of support 120 that flexible joint 120 provides allows play mat 100 to be more compact, less bulky and portable than previously designed mats. Portability is an important feature because it enables users of play mat 100 to travel with play mat 100 with ease and convenience. Such ease of portability also enables users of play mat 100 to use it more often. In some embodiments, support 120 may be covered with a cushioned decorative fabric. Support 120 is shown in its folded, more compact position in FIG. 2B.

Figure 2C:
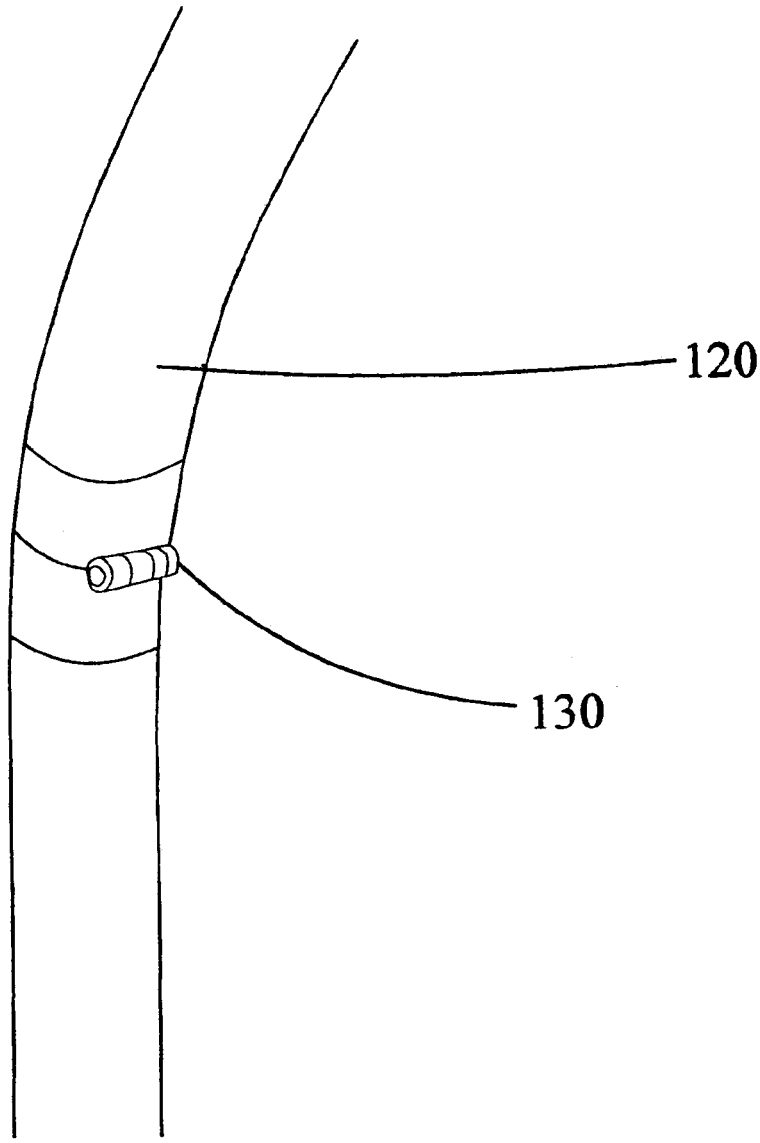
FIG. 2C shows one embodiment of the flexible joint portion of the support shown in FIG. 2A.

Referring to FIG. 2C, one embodiment of flexible joint 130 in support 120 is shown. Optionally, flexible joint 130 is positioned approximately midway down the length of support 120 so as to provide an optimal reduction in the length of support 120 when support 120 is folded at flexible joint 130. Flexible joint 130, however, may be positioned any where on support 120 that causes a reduction in the length of support 120. Flexible joint 130 may be implemented using a joint such as a hinge that enables support 120 to be foldable so that it will be reduced in length. Optionally, flexible joint 130 and support 120 may be designed so that a downward force, such as an infant's pulling downward on support 120 will not cause support 120 to fold or collapse onto the infant. This feature of play mat 100 provides an additional lever of safety and security for any infant resting or playing on mat 100.

Figure 2D:
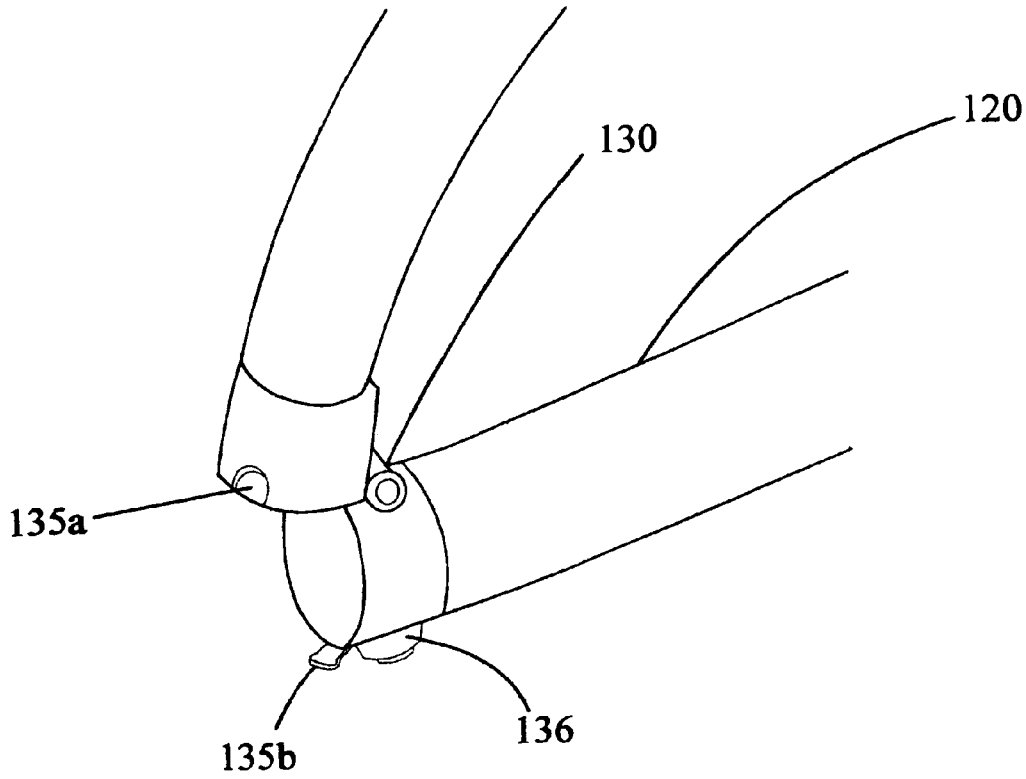
FIG. 2D shows the flexible joint and locking mechanism portion of the support shown in FIG. 2C when the support is in the folded position.

FIG. 2D shows flexible joint 130 and locking mechanism 135 of support 120 that is shown FIG. 2C when support 120 is in the folded position. When support 120 is in the unfolded, extended position locking mechanism 135 may be engaged so that support 120 remains in the extended position. When support 120 is folded support 120 may be described as having an upper portion, the support length above flexible joint 130 and a lower portion, the support length below flexible joint 130. Locking mechanism 135 shown in FIG. 2C has two parts, 135*a* and 135*b*. In this embodiment, part 135*a* is on the upper length of support 120 and part 135*b* is on the lower length of support 120. To engage parts 135*a* and 135*b* the parts are constructed so that part 135*a* fits tightly into part 135*b* so that it is difficult for the parts to become uncoupled or disengaged without a sufficient pulling force being applied.

Locking mechanism 135 remains in the locked or engaged position until it is disengaged. Several methods may be used to disengage locking mechanism 135. One method of disengagement includes release mechanism 136. Release mechanism 136 may be constructed using a push button that causes part 135*b* to be released from part 135*a* or vice versa. Alternatively, locking mechanism 135 may be disengaged when parts 135*a* and 135*b* are physically pulled apart. An average adult possesses sufficient strength required to pull parts 135*a* and 135*b* apart. Preferably, the level of strength required is far beyond that possessed by an infant or small child.

Figure 2E:
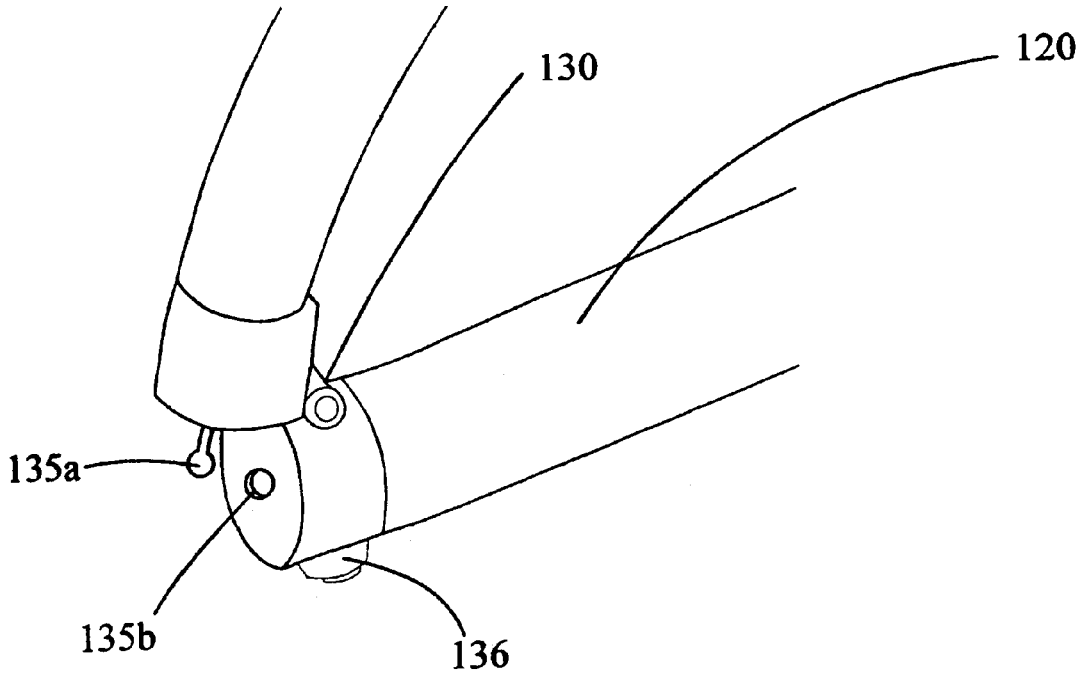
FIG. 2E shows the flexible joint and an alternative locking mechanism of the support shown in FIG. 2C.

Locking mechanism 135 may be implemented using a variety of devices. For example, FIG. 2E shows flexible joint 130 and an alternative locking mechanism 135 used on support 120. In this embodiment, locking mechanism 135 is formed by a protrusion with a bulb shaped end which extends from the interior portion of the upper portion of support 120 that is designed to tightly fit into a receiving opening or bulb shaped opening in the interior portion of the lower portion of support 120 when support 120 is in the unfolded, extended position. Locking mechanism 135 may be designed to have a pressure fit which would require some force be applied to pull the protrusion out from the lower portion of support 120.

Alternatively, based on the particular design of locking mechanism 135 release mechanism 136 may be optionally employed to cause the bulb shaped protrusion to be released from the receiving opening in the lower interior portion of support 120. Other alternative designs for both locking mechanism 135 and release mechanism 136 may be used to cause support 120 to remain in the extended, unfolded position until an action is taken by the adult user of mat 100 that disengages locking mechanism 135.

Yet another alternative for implementing the locking and release features of the invention is to use a simple clasp type mechanism that connects the lower and upper portions of support 120. A clasp typically requires manual manipulation to release or unclasp a portion of the clasp-type mechanism which allows the upper and lower portions of support 120 to be separated or unlocked and foldable at flexible joint 130.

Such a clasp-type mechanism may also be used to simplify the design and manufacturing requirements of play mat 100.

Figure 3A:
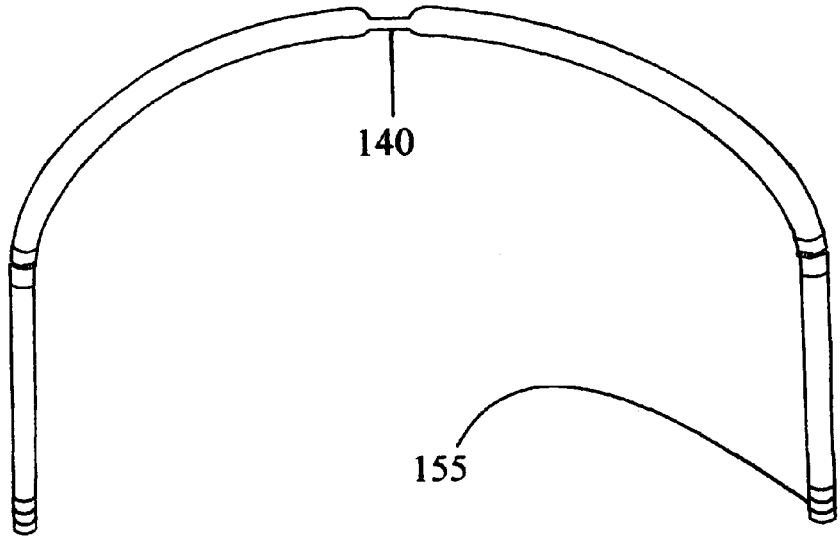
FIG. 3A shows one embodiment of the support having height extension members included in the support.
Figure 3B:
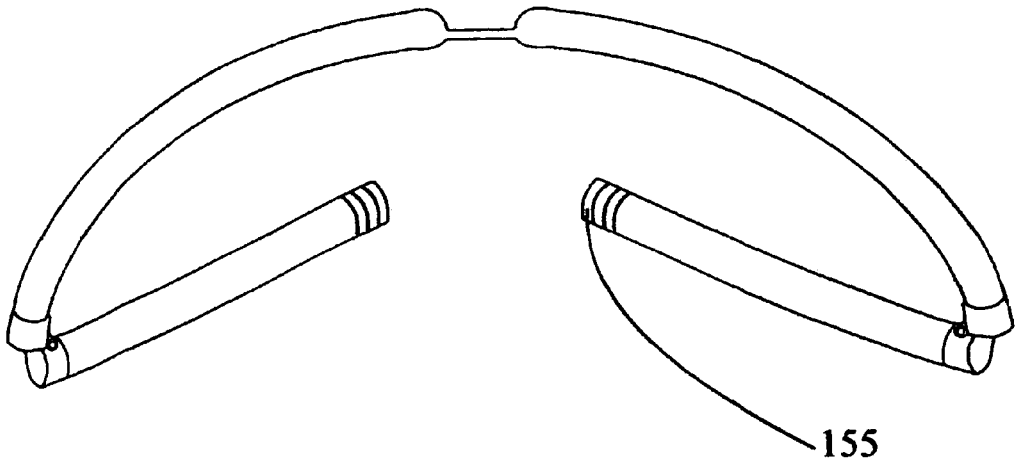
FIG. 3B shows the support shown in FIG. 3A in the folded position.

Referring to FIG. 3A, one embodiment of support 120 is shown having flexible joint 130, support top portion 140 and height extension member 155 including in support 120. In this embodiment, height extension member 155 is positioned at the bottom of support 120. Height extension member 155, however, may be positioned at any point on support 120 that will allow the height of support 120 to be adjusted relative to base 110. In this embodiment, the need to have a separate height extension component is eliminated. As a result of the reduced number of component required this embodiment of play mat 100 may require less time to assemble and disassemble than other embodiments. FIG. 3B shows support 120 of FIG. 3A in the folded position.

Figure 4A:
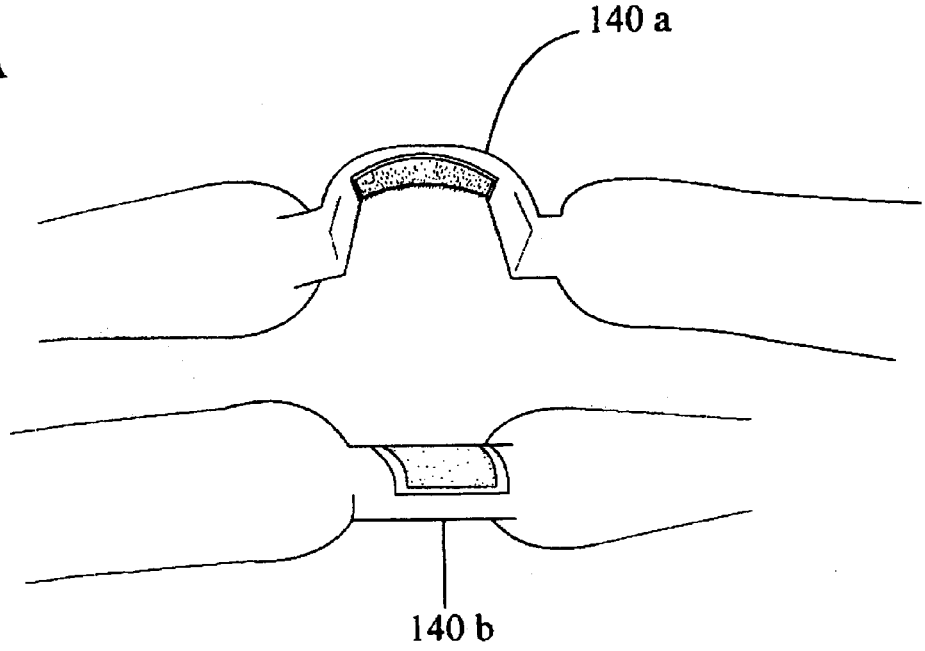
FIG. 4A shows the top portion of the supports having synthetic adhesive material, wherein the supports are in the uncoupled state.

Referring to FIG. 4A, top end 140 of both supports are shown uncoupled or detached from each other. In this embodiment, top end 140 includes a coupling mechanism that may be constructed using a synthetic material which adheres when pressed together. The synthetic adhesive material is shown in FIG. 4A on top end 140. For clarity, the top end of a first support is referred to as top end 140*a* and the top end of a second support is referred to as top end 140*b*. The synthetic material used may include VELCRO® or the like and should be sufficient to couple a plurality of support 120 together in a sturdy manner. Alternatively, top end 140 may be coupled using a sturdy snap or plurality of sturdy snaps that connect a plurality of supports 120 together at top end 140. Such snaps may be part of the decorative fabric that in some embodiments of play mat 100 cover each support 120. The snaps may be made of plastic or metal. Preferably, one sturdy snap may be used to couple a plurality of supports 120 together when play mat 100 is fully assembled.

Figure 4B:
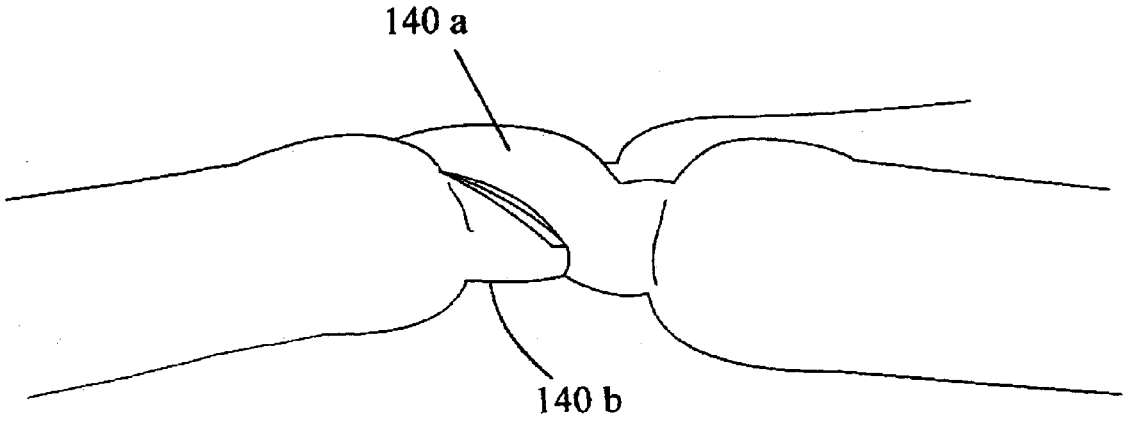
FIG. 4B shows the top portion of the supports of FIG. 4A coupled together using a synthetic material that adheres when the supports are pressed together.

FIG. 4B shows top ends 140*a* and 140*b* from FIG, 4A detachably coupled to each other using a synthetic material that adheres when pressed together. Within this specification, detachably coupled refers to any portion of play mat 100 that is coupled and that is also designed so that it may be uncoupled or detached with relative ease for the purpose of disassembling play mat 100. Referring to the embodiment shown in FIG. 4B, when play mat 100 is assembled, top end 140 is detachably coupled to the top end of at least one other top end 140 of another support 120, as shown in FIG. 4B. The top ends of each support 120 are coupled together so that at least two supports intersect over base 110.

Figure 4C:
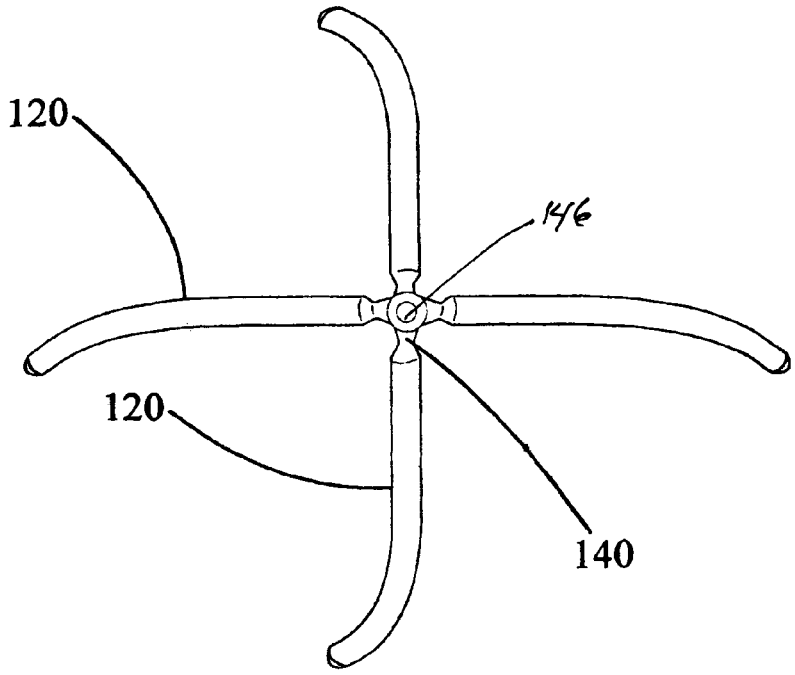
FIG. 4C shows a top view of the supports coupled using a push button device. The supports are shown in the open, fully assembled position.

FIG. 4C shows top end 140 of each support 120 coupled together using coupling mechanism that includes a push button coupling mechanism 146. In FIG. 4C supports 120 are in the open or assembled position.

Figure 4D:
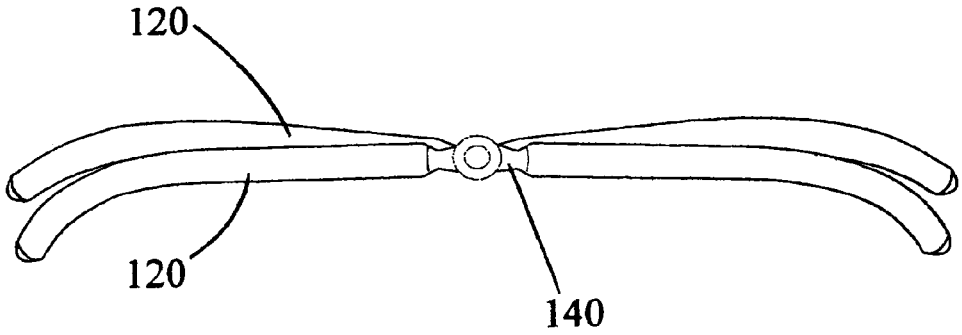
FIG. 4D shows a top view of the supports of FIG. 4C, where the supports are in closed or aligned position.
Figure 4E:
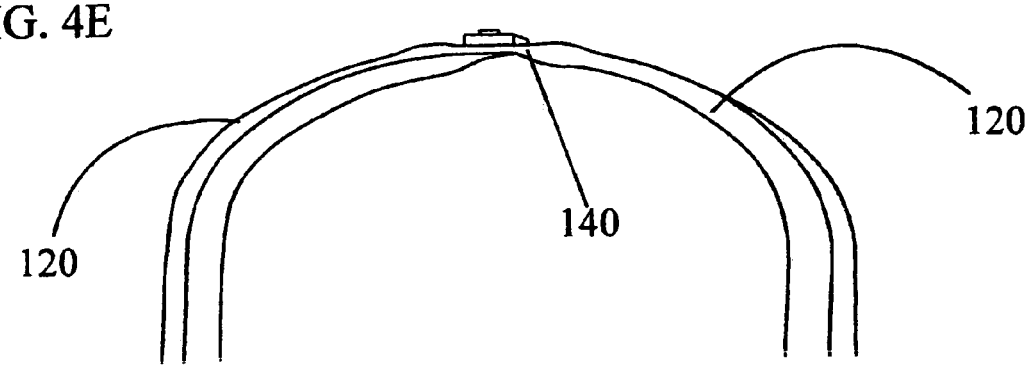
FIG. 4E shows a side view of the supports shown in FIG. 4D in an aligned position.

FIG. 4D shows a top view of push button coupling mechanism 146 of FIG. 4C. Here supports 120 are shown in closed or aligned position. In an embodiment of play mat 100 that implements push button coupling mechanism 146, supports 120 preferably remain coupled even when mat 100 disassembled. When push button coupling mechanism 146 is pressed supports 120 are caused to align with one another as shown in FIG. 4E. FIG. 4E shows a side view of support 120 having the push button coupling mechanism shown in FIG. 4D in the closed or aligned position. The optional features that enable supports 120 to be aligned and folded result in a significant reduction in the length and bulkiness of supports 120. This size reduction enable supports 120 to be stored in a carrying case and transported with relative ease. Although, FIGS. 4A-4E depicts two types of coupling mechanisms and a third is described above, any device may be used to couple supports 120 together in a manner that sufficient to maintain supports 120 in the assembled, upright position.

Referring to FIGS. 5A-5F, one version of height extension member 150 is shown. Height extension member 150 may be constructed using a telescoping column mechanism that extends to provide more height to support 120 relative to base 110. In FIGS. 5A-5F, the telescoping mechanism is depicted.

Figure 5A:
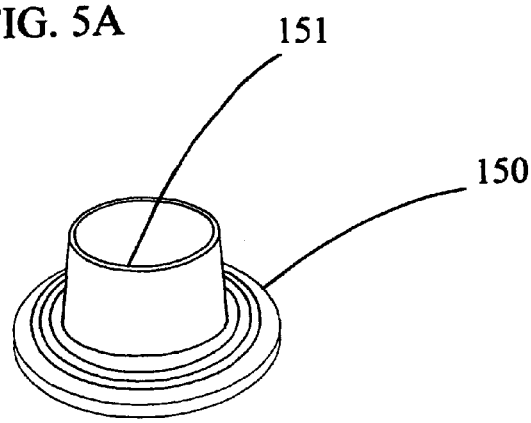
FIG. 5A shows a top view of one embodiment of the telescoping mechanism in the unextended position without a positioning mechanism.

FIG. 5A shows a top side view of one embodiment of the telescoping mechanism in the unextended position. This version of height extension member does not include a positioning mechanism.

Figure 5C:
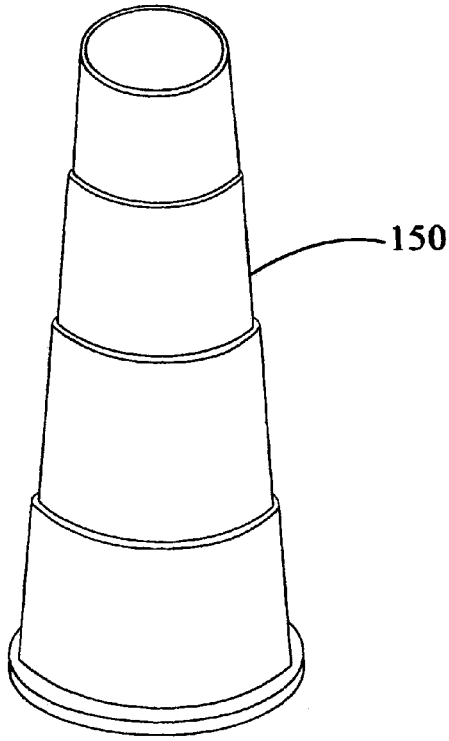
FIG. 5C shows a three-dimensional side view of the telescoping mechanism shown in FIG. 5A in the extended position.
Figure 5B:
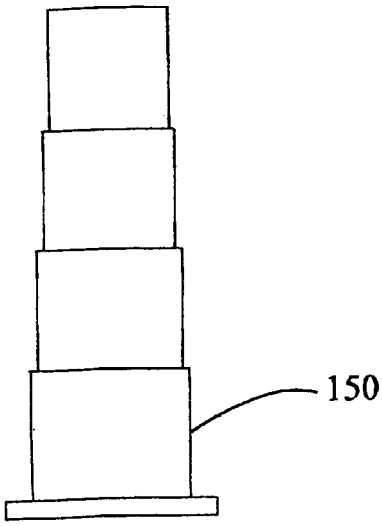
FIG. 5B shows a two-dimensional side view of the telescoping mechanism shown in FIG. 5A in the unextended position.

FIG. 5B shows a two-dimensional side view of the telescoping mechanism of FIG. 5A in the extended position.

FIG. 5C shows a three-dimensional view of the telescoping mechanism shown in FIG. 5A in the extended position.

Figure 5D:
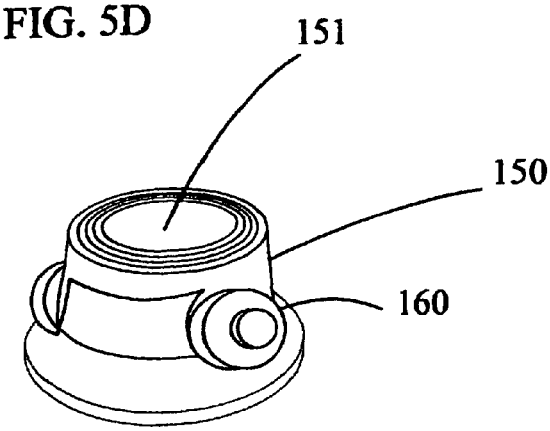
FIG. 5D shows a perspective view of one embodiment of the telescoping mechanism having a positioning mechanism.

Referring to FIG. 5D, telescoping mechanism 150 may have an opening, such as opening 151 that receives one end, either 120*a* or 120*b*, of the bottom end of support 120. Opening 151 is designed to receive bottom ends 120*a* or 120*b* so that bottom ends 120*a* or 120*b* fit securely in opening 151. Opening 151 may also be designed so that bottom ends 120*a* and 120*b* can be detached from opening 151 when they are pulled from opening 151. Alternatively, other embodiments of the present invention do not require opening 151 for coupling height extension member 150 to support 120. For example, height extension member 150 may be coupled to the bottom of support 120 by designing support 120 to have a receiving end into which height extension member 150 may be inserted or attached.

Telescoping mechanism 150 enables the height of support 120 relative to base 110 to be upwardly or downwardly adjusted or extended by several inches. Optionally, telescoping mechanism 150 provides a height extension of at least 3 inches. Such height adjustability allows play mat 100 to be used by infants of various sizes and during various stages of their development. Previously designed mats do not have such adjustability and therefore their use is restricted to smaller and/or younger infants.

Also referring to FIG. 5D, one embodiment of telescoping mechanism 150 includes positioning mechanism 160. Positioning mechanism 160 enables telescoping mechanism 150 to lay flat on base 110 when play mat 100 is be folded for disassembly and transport. In this embodiment, telescoping mechanism 150 may be positioned to lay flat on base 110 so that base 110 can be easily folded without the additional step of detaching the plurality of telescoping mechanisms 150 from base 110. The positioning of each telescoping mechanism 150 occurs after support 120 is decoupled from telescoping mechanism 150.

Figure 5F:
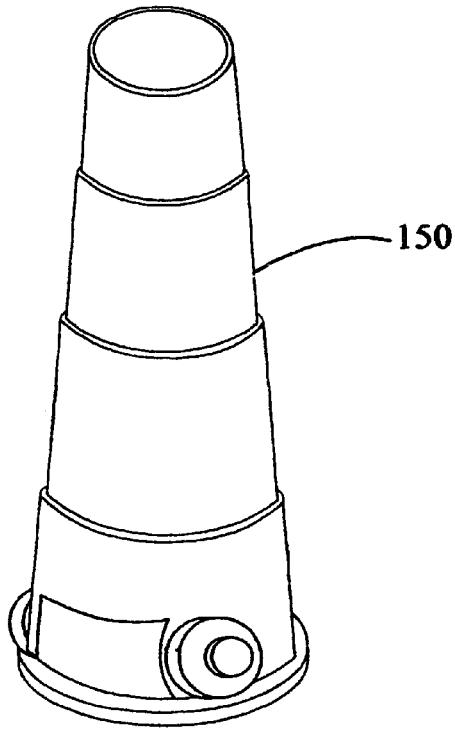
FIG. 5F shows a three-dimensional side view of the telescoping mechanism shown in FIG. 5D in the extended position.
Figure 5E:
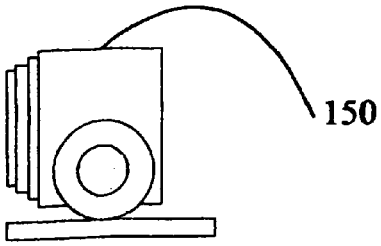
FIG. 5E shows a two-dimensional side view of the telescoping mechanism shown in FIG. 5D in the unextended position.

Referring to FIG. 5E, telescoping mechanism 150 of FIG. 5D is shown in the unextended position. FIG. 5F shows a three dimensional view of telescoping mechanism 150 of FIG. 5D in the fully extended position.

Figure 6A:
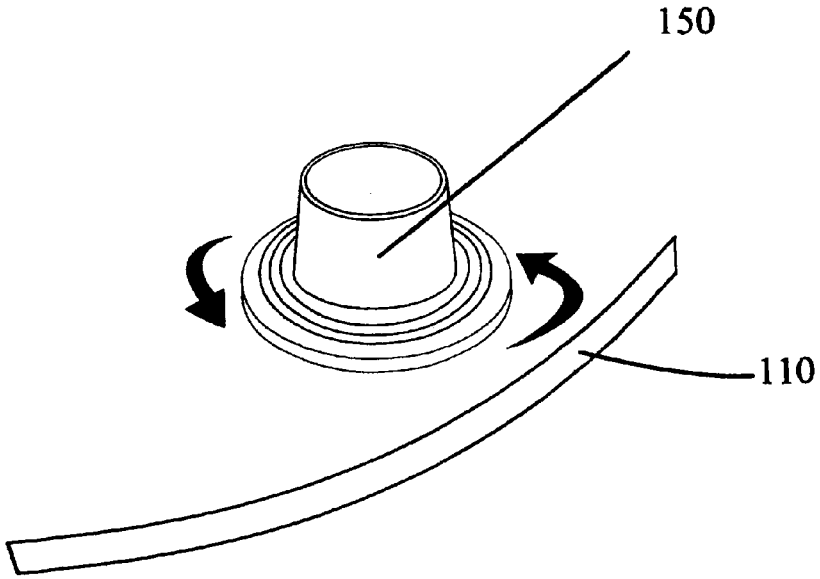
FIG. 6A shows a top, side view of one embodiment of the telescoping mechanism attached to the base portion of the play mat.
Figure 6B:
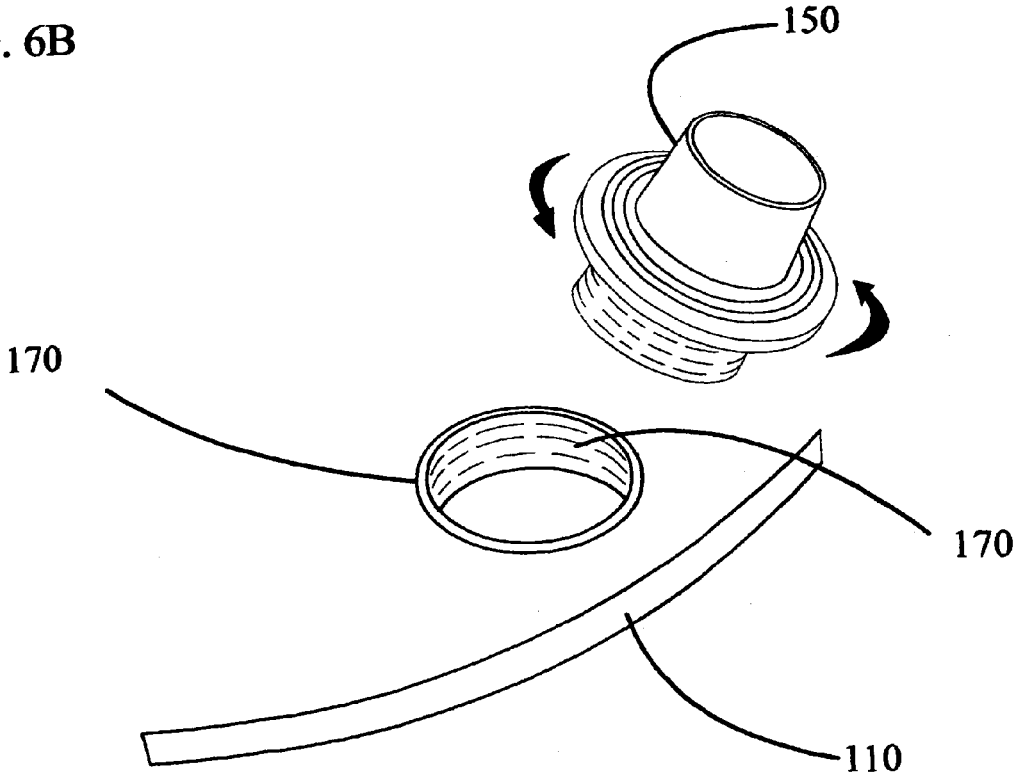
FIG. 6B shows the telescoping mechanism shown in FIG. 6A having a bottom that is coupled to a corresponding receiving portion on the base.

Referring to FIG. 6A, one embodiment of telescoping mechanism 150 is shown attached to base 110 in the unextended position. FIG. 6B shows receiving portion 170 in base 110. In this embodiment, the bottom portion of telescoping mechanism 150 has grooves that correspond to grooves in receiving portion 170 of base 110. These grooves allow telescoping mechanism 150 to be detachably coupled to base 110. The bottom portion of telescoping mechanism 150 is coupled to base 110 by turning telescoping mechanism 150 in the direction which screws telescoping mechanism 150 into base 110. Telescoping mechanism 150 may be detached from base 110 by screwing telescoping mechanism 150 in the direction that unscrews it from base 110. Optionally, the grooved bottom portion of telescoping mechanism 150 are constructed so that the bottom portion can be turned or screwed into and unscrewed out from base 110 while the top portion of telescoping mechanism 110 remains in a fixed position relative to the bottom portion that is being turned. More specifically, the bottom and top portions of telescoping mechanism 150 may be constructed so using two separate parts that allow the bottom portion to be screwed into or out from base 110 without requiring that support 120 first be uncoupled from the top portion of telescoping mechanism 150.

Telescoping mechanism 150 may be coupled to base 110 using techniques other than a grooved receiving portion like receiving portion 170, as discussed above. For example, the bottom portion of telescoping mechanism 150 may be designed so that it fits tightly or is pressure fit into receiving portion 170 without the need of screwing telescoping mechanism 150 into receiving portion 170. Pressure fitting telescoping mechanism 150 into receiving portion 170 of base 110 provides a simple means of detachably coupling telescoping mechanism 150 to base 100. For the purposes of disassembling and transporting play mat 100 or to clean and/or wash the fabric covering of base 110 telescoping mechanism 150 may be easily detached from base 110 by pulling it out from receiving portion 170

Another alternative method of detachably coupling telescoping mechanism 150 to base 110 is to use snaps that are embedded in the fabric covering to detachably couple telescoping mechanism 150 to base 110. When using snaps as the coupling means the fabric covering may be design so that it can be gathered around the bottom portion of telescoping mechanism 150 allowing the snaps to be engaged and thereby detachably coupling telescoping mechanism 150 to base 110. Optionally, using the snap arrangement, support 120 may be detachably coupled directly to base 110 in an embodiment that does not include a separate height extension member such as telescoping mechanism 150.

Figure 7:
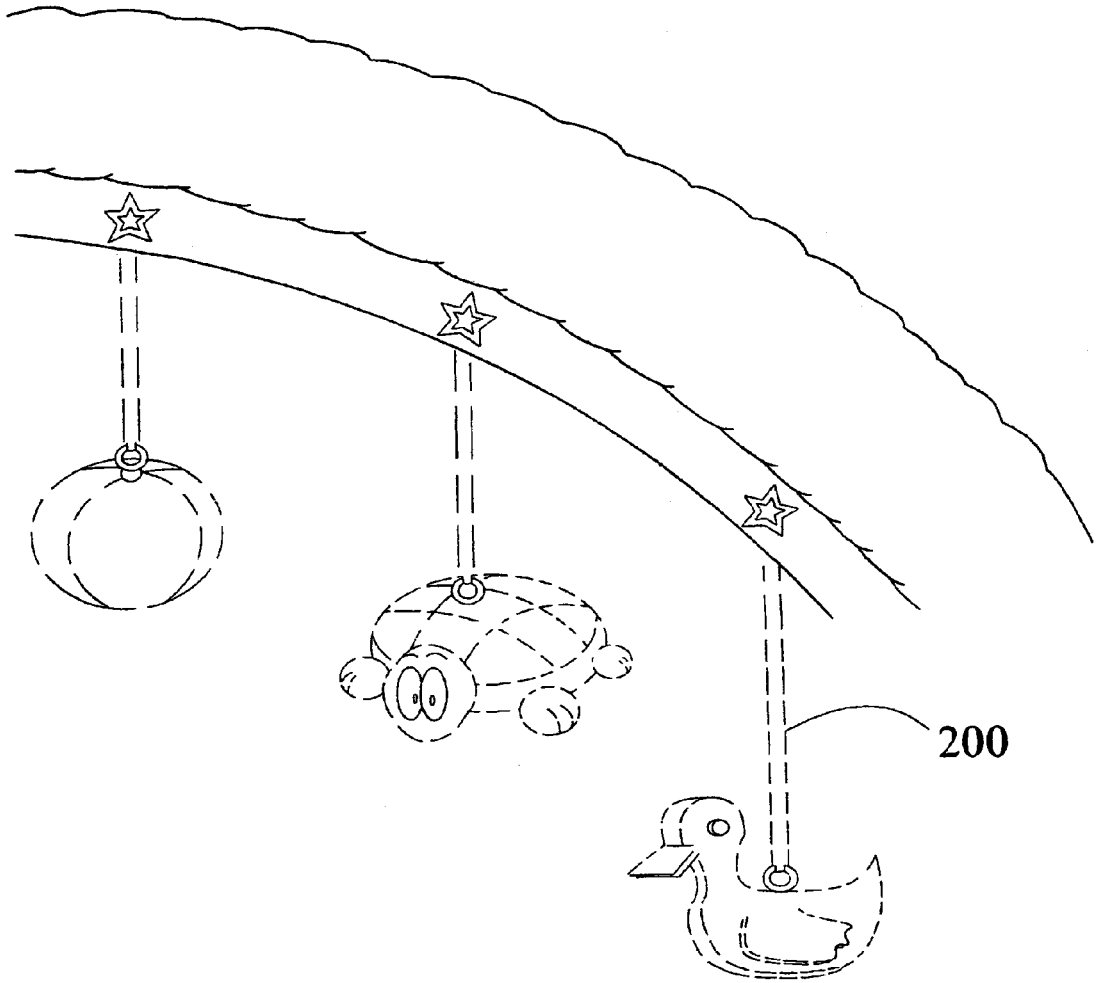
FIG. 7 shows an attachment means from which toys and other objects may be attached to the supports.

Referring to FIG. 7, one embodiment of infant play mat 100 shows that support 120 may include attachment means 200 that allows various small objects such as toys to be hung from support 120 for the infant's amusement. In one embodiment, support 120 is covered with a decorative fabric that includes decorative holes from which attachment means 200 may be attached to allow objects such as toys to hang over base 110 for the amusement of the infants using play mat 100.

Attachment means 200 may be from any synthetic material that adheres together when pressed together. Such synthetic materials may include VELCRO®. An attachment means made from VELCRO® or a synthetic adhering material may be attached or made to adhere directly to the fabric that covers support 120. Alternatively, the synthetic material may be pulled through the decorative holes and made to adhere to itself in the form of a hook or loop from which objects can hang. Attachment means 200 may also include hook, hook and eye, string or any material that can fit through the decorative holes in the fabric that covers support 120. The decorative holes may be constructed in the shape of half-moons, circles, stars or the like. Moreover, the holes may be constructed to be lighted so as to provide further amusement and fascination for the infant, particularly in a dark setting. The light may be provided by a battery or electricity source stored in either support 120 or base 110. Objects or toys may also be hung from beneath top portion 140 using attachment means 200.

Alternatively, attachment means 200 may include a decorative tubular-shaped or elongated material made from padded or cushioned fabric, plastic, wood or any other synthetic material on which hanging toys and objects may be attached. This decorative piece of material includes clamps coupled to each end of attachment means 200. In one embodiment, the clamps are used to connect attachment means 200 to support 120 so that the toys can hang down or dangle over base 110 of mat 100 without being directly attached to support 120 or the fabric covering support 120. Also a version of attachment means 200 which is constructed using clamps has the advantage of allowing the user to remove all of the toys from mat 100 simultaneously as opposed to individually.

Figure 8A:
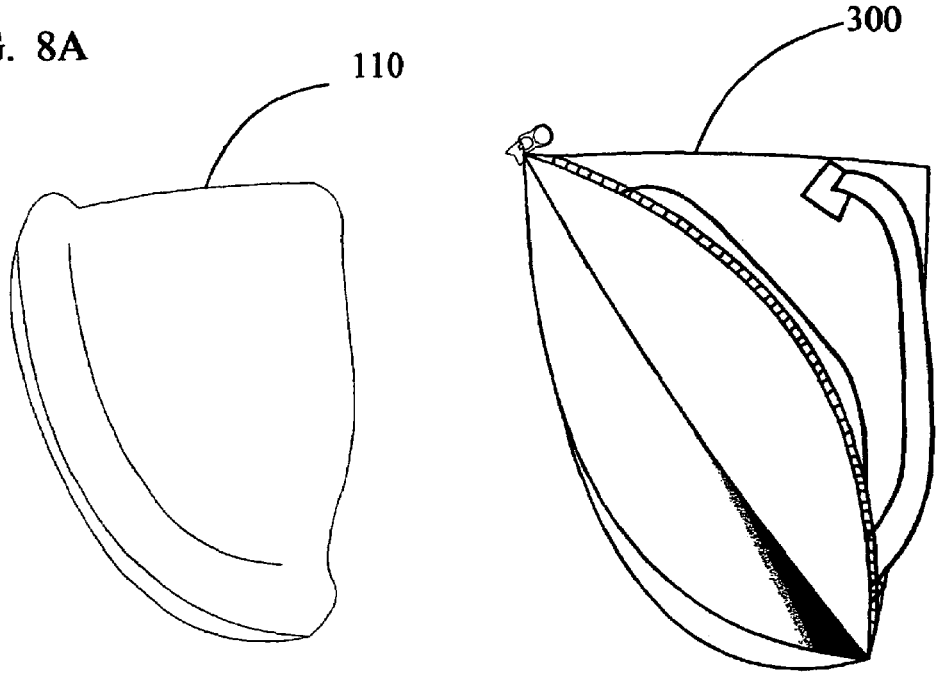
FIGS. 8A and 8B show the base of the mat and the supports in the folded position and a carrying triangular-shaped backpack.
Figure 8B:
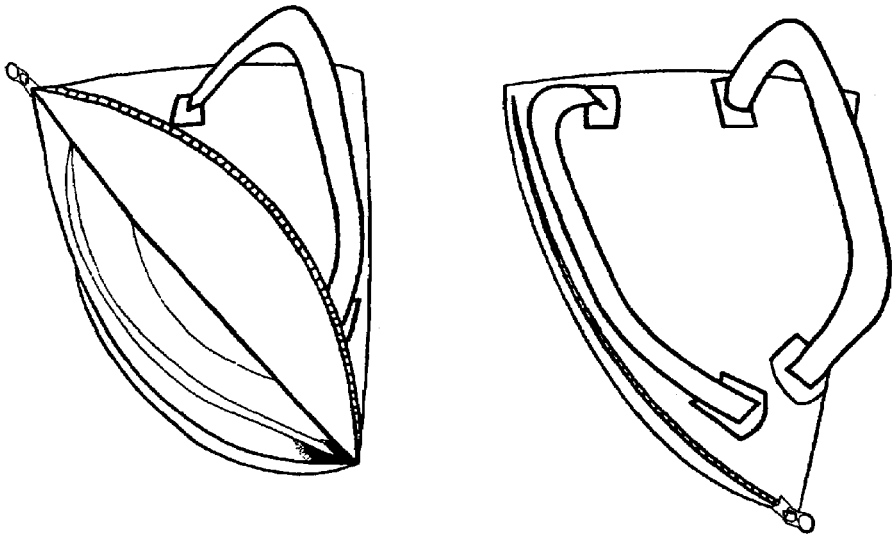

Referring to FIGS. 8A and 8B, one embodiment of play mat 100 shows base 110 folded two to three times so that the shape of folded base 110 resembles that of a pie and can fit easily and conveniently into triangular-shaped backpack 300. In addition, backpack 300 may be designed so that at least two folded supports 120 along with base 110 and optionally height extension members easily and conveniently fit into backpack 300. Backpack 300 is designed to accommodate the shape of play mat 100 in its folded compact form. Backpack 300 may alternatively be designed in more generally to accommodate the folded play mat 100.

Figure 9A:
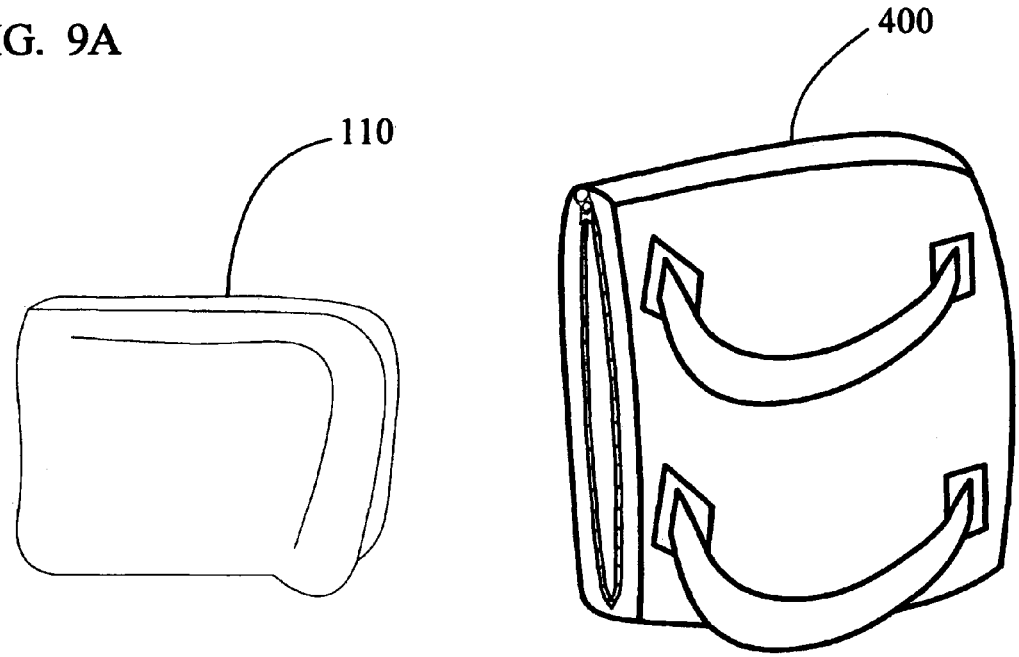
FIGS. 9A and 9B show the base of the mat and the supports in the folded position and a carrying rectangular-shaped backpack.
Figure 9B:
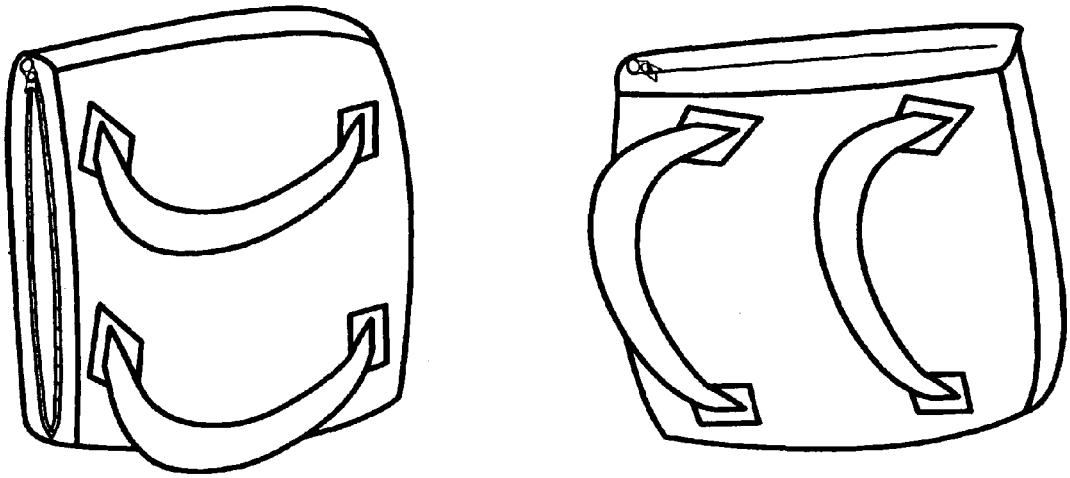

Referring to FIGS. 9A and 9B, in another embodiment of play mat 100 base 110 has a rectangular shape. Base 110 can be folded two to three times so that its shape resembles a small rectangle or square. In this small form base 110 can easily and conveniently be placed into backpack 400. Here, as shown in FIGS. 9A and 9B, backpack 400 may be designed to accommodate the specific shape of play mat 100 in its folded compact form.

The method of assembly for the embodiment of play mat 100 that is shown in FIGS. 1A and 1B includes removing a plurality of supports 120, base 110 and a plurality of telescoping mechanisms 150 from a carrying case such as backpack 300 or backpack 400. After all the components of play 100 are removed from the carrying case, base 110 is unfolded and placed on a rigid surface such as a floor. Each support 120 is also unfolded. After each support 120 is unfolded locking mechanism 135 may be engaged so that support 120 will remain in the unfolded, extended or assembled position until locking mechanism 135 is disengaged. Locking mechanism 135 may be disengaged by pressing release mechanism 136 or by applying the required level of manual force, i.e., pulling apart support 120 to cause locking mechanism 135 to be disengaged and to cause support 120 to fold. Alternative methods of disengagement may also be implemented to cause support 120 become unlocked and foldable.

The bottom end of support 120 is detachably coupled to the top end of telescoping mechanism 150 and the bottom end of telescoping mechanism is similarly detachably coupled to base 110. The top end of each support 120 is coupled to each other top end so that a plurality of supports 120 intersects over base 110. If desired, telescoping mechanism 150 may be adjusted so that the height of or more specifically the top portion support 120 is extended upwardly or downwardly relative to base 110. Toys or other objects may be attached to support 120 using attachment means 200 so that they hang over base 110. An audio playing/recording device that may be contained in base 110 may be activated so that the infant is able to listen to an audio program such as music, a story, a personalized message from its parents or the like.

One advantage of mat 100 is that it may be adjusted to accommodate the size and age of an infant using the mat.

Previously designed infant play mats do not have any height adjustment means to accommodate for the increased size or height of an infant as it gets older. As a result such mats are quickly outgrown by infants and discarded by their parents. The height adjustment feature allows the mat presented here to be used for a longer period during the baby's infancy than is possible with other mats that do not have this feature. An infant, whether sitting up or laying down on base 110 can enjoy the beneficial features of the present invention.

Another advantage of mat 100 is that support 120 may be foldable. This foldable feature allows support 120, a main component of mat 100 to be reduced in size so that it easily fits in to a carry case and be conveniently transported from place to place. This foldable feature reduces the bulkiness that is normally associated with dissembled infant mats.

Another advantage of mat 100 is that it may be designed so that it is easy to assemble and disassemble. Thus, the time required to assemble and dissemble the mat is reduced.

Another advantage of mat 100 is that base 110 may be made of or covered with stain-resistant and/or waterproof durable material. This feature makes this mat easy to be cleaned by wiping or allows it to be machine washable. Unlike other mats that cannot be easily cleaned and are therefore discarded or unusable long before their utility has faded, the washable nature of mat 100 allows mat 100 to be used for a much longer period of time.

Another advantage of mat 100 is that it may be constructed using light-weight materials such as light-weight plastic or metal. This feature is advantageous because it allows the user to conveniently transport the mat from place to place.

Another advantage of mat 100 is that it may include an audio player/recorder device. This feature is advantageous because it allows the user to select of variety of different types of audio programs that may be desirable for their infant to listen to. Unlike other mats that may include prerecorded music that cannot be changed, the mat presented herein allows the user to change the audio program as many times is desirable. Using this feature parents can not only design specific audio programs that may include cultural or ethnic music, parents may play language or educational programs or include personalized messages so that the infant can grow accustomed to the parents' voice or be soothed by a parent's voice even when that parent in not present.

The present invention does not require all of the advantageous features and all of the advantages to be incorporated in every embodiment of the invention. Moreover, although the present invention has been described in considerable detail, with reference to certain embodiments, other embodiments are possible. Therefore, the spirit and scope of the appended claims should not be limited to the description of the embodiments contained herein.

What is claimed is:

1. A mat comprising:

a base;

a plurality of telescoping mechanisms, wherein each said telescoping mechanism has a receiving portion and a bottom end;

a plurality of hinges; and a plurality of supports each having a top end and a bottom end, wherein said bottom end of each said support is detachably coupled to said receiving portion of each said telescoping mechanism and the bottom end of each said telescoping mechanism is detachably coupled to said base and wherein at least two said hinges are coupled to each said support to allow each said support to be folded, wherein said top end of each said support is coupled to the top end of another said support so that said supports intersect over said base.

2. The mat as recited in claim 1, wherein said top end of each said support is detachably coupled to the top end of another said support so that said supports can be detached from each other.

3. The mat as recited in claim 1, wherein said top end of each said support is coupled to the top end of another said support using a push button coupling mechanism.

4. The mat as recited in claim 1, wherein said base includes a receiving portion that allows the bottom end of each said telescoping mechanism to be detachably coupled to said base.

5. The mat as recited in claim 1, wherein each said support further comprises a plurality of locking mechanisms that when engaged allow each said support to remain locked in an unfolded position until each said locking mechanism is disengaged.

6. The mat as recited in claim 1, wherein said base includes an accessible interior area to hold an audio recording/playback device.

7. The mat as recited in claim 1, further comprising an audio play/record device.

8. The mat as recited in claim 1, further comprising an attachment means for attaching objects to each said support.

9. The mat as recited in claim 1, further comprising a carrying case for transporting said plurality of supports and telescoping mechanisms and said base when they are dissembled.

10. The mat as recited in claim 9, wherein said carrying case is a backpack.

11. A mat comprising:

a base; and a plurality of supports each having a top end and a bottom end, wherein said bottom end of each said support is detachably coupled to said base and each said support includes a plurality of flexible joints that enable each said support to be folded, wherein said top end of each said support is coupled to the top end of another said support so that said supports intersect over said base, wherein said top end of each said support is coupled to the top end of another said support using a push button coupling mechanism.

12. The mat as recited in claim 11, wherein each said support further comprises a plurality of locking mechanisms that when engaged allow each said support to remain locked in an unfolded position until each said locking mechanism is disengaged.

13. The mat as recited in claim 11, wherein said top end of each said support is detachably coupled to the top end of another said support so that said supports can be detached from each other.

14. The mat as recited in claim 11, wherein said base includes a receiving portion that allows the bottom end of each said support to be detachably coupled to said base.

15. The mat as recited in claim 11, wherein said base includes an accessible interior area to hold an audio recording/playback device.

16. The mat as recited in claim 11, further comprising an audio play/record device.

17. The mat as recited in claim 11, further comprising an attachment means for coupling objects to each said support.

18. The mat as recited in claim 11, further comprising a carrying case for transporting said plurality of supports and said base when they are dissembled.

19. The mat as recited in claim 18, wherein said carrying case is a backpack.

20. A mat comprising:

a base;

a plurality of height extension members each having a top end and a bottom end; and a plurality of supports each having a top end and a bottom end, wherein the bottom end of each said support is detachably coupled to the top end of each said height extension member and the bottom end of each said height extension member is detachably coupled to said base, wherein said top end of each said support is coupled to the top end of another said support so that said supports intersect over said base.

21. The mat as recited in claim 20, wherein each said support further comprises a plurality of flexible joints that enable each said support to be folded.

22. The mat as recited in claim 20, wherein each said support further comprises a plurality of locking mechanisms that when engaged allow each said support to remain locked in an unfolded position until each said locking mechanism is disengaged.

23. The mat as recited in claim 20, wherein said top end of each said support is detachably coupled to the top end of another said support so that said supports can be detached from each other.

24. The mat as recited in claim 20, wherein said top end of each said support is coupled to the top end of another said support using a push button coupling mechanism.

25. The mat as recited in claim 20, wherein said base includes a receiving portion that allows the bottom end of each said height extension member to be detachably coupled to said base.

26. The mat as recited in claim 20, wherein said base includes an accessible interior area to hold an audio recording/playback device.

27. The mat as recited in claim 20, further comprising an audio play/record device.

28. The mat as recited in claim 20, wherein said base can be folded without detaching said plurality of height extension members from said base so that said mat can be stowed away without complete disassembly.

29. The mat as recited in claim 20, further comprising an attachment means for coupling objects to each said support.

30. The mat as recited in claim 29, wherein said attachment means includes decorative shapes that are lighted.

31. The mat as recited in claim 20, further comprising a carrying case for transporting said plurality of supports, said height extension members and said base when they are dissembled.

32. The mat as recited in claim 31, wherein said carrying case is a backpack.

33. A mat comprising:

a base; and a plurality of telescoping supports having a top and a bottom end, wherein the bottom end of each said telescoping support is detachably coupled to said base, wherein the top end of each said telescoping support is coupled to the top end of another said telescoping support so that said plurality of telescoping supports intersect over said base, wherein each said telescoping support further comprises a plurality of flexible joints that enable each said support to be folded.

34. The mat as recited in claim 33, wherein said top end of each said telescoping support is detachably coupled to the top end of another said telescoping support so that said telescoping supports can be detached from each other.

35. The mat as recited in claim 33, wherein said top end of each said telescoping support is coupled to the top end of another said telescoping support using a push button coupling mechanism.

36. The mat as recited in claim 33, wherein each said telescoping support further comprises a plurality of locking mechanisms that when engaged allow each said support to remain locked in an unfolded position until said locking mechanism is disengaged.

37. The mat as recited in claim 33, wherein said base includes a receiving portion that allows the bottom end of each said telescoping support to be detachably coupled to said base.

38. The mat as recited in claim 33, wherein said base includes an accessible interior area to hold an audio recording/playback device.

39. The mat as recited in claim 33, further comprising an audio play/record device.

40. The mat as recited in claim 33, further comprising an attachment means for coupling objects to each said support.

41. The mat as recited in claim 33, further comprising a carrying case for transporting said plurality of telescoping supports and said base when they are dissembled.

42. The mat as recited in claim 41, wherein said carrying case is a backpack.

43. A method of assembly for a mat, comprising the steps of:

placing a base on a rigid surface;

unfolding a plurality of supports having a top end and a bottom end;

detachably coupling a height extension member having a top and a bottom end to said base, wherein said bottom end of said height extension member is detachably coupled to said base and detachably coupling the top end of said height extension member to said bottom end of each said support; and coupling said top end of each said support to the top end of another said support so that said supports intersect over said base.

44. The method recited in claim 43, further comprising the step of:

engaging a locking mechanism that allows said supports to remain in the unfolded extended position until disengaged.

45. The method recited in claim 43, further comprising the step of:

adjusting said plurality of height extension members to increase the height of said plurality of supports relative to said base.

46. The method recited in claim 43, further comprising the step of:

connecting an attachment means having objects to said plurality of supports.

47. The method recited in claim 43, further comprising the step of:

activating an audio playing/recording device so that the infant can listen to a recorded audio program.

48. The method recited in claim 43, further comprising the step of:

removing said base, said plurality of supports, and said plurality of height extension members from a carrying case.

* * * * *